US007081001B1

(12) United States Patent
Conroy et al.

(10) Patent No.: US 7,081,001 B1
(45) Date of Patent: Jul. 25, 2006

(54) PUSH AND TWIST ELECTRICAL CONNECTOR ASSEMBLY

(75) Inventors: David Conroy, Brooklyn, NY (US); Chi Yu, Brooklyn, NY (US)

(73) Assignee: Lowel-Light Manufacturing Inc., Brooklyn, NY (US)

( * ) Notice: Subject to any disclaimer, the term of this patent is extended or adjusted under 35 U.S.C. 154(b) by 0 days.

(21) Appl. No.: 11/353,782

(22) Filed: Feb. 14, 2006

(51) Int. Cl.
*H01R 13/62* (2006.01)

(52) U.S. Cl. ..... 439/314; 439/319

(58) Field of Classification Search ..... 439/332, 439/335, 336, 319, 314
See application file for complete search history.

(56) References Cited

U.S. PATENT DOCUMENTS

| | | | | |
|---|---|---|---|---|
| 1,304,075 | A | 5/1919 | Lofgren | |
| 1,559,684 | A * | 11/1925 | Douglas | 439/335 |
| 2,005,475 | A | 6/1935 | Schmidt | |
| 2,093,037 | A | 9/1937 | Douglas | |
| 2,729,800 | A * | 1/1956 | Knudsen | 439/335 |
| 3,116,942 | A * | 1/1964 | Morello, Jr. | 439/314 |
| 3,701,965 | A | 10/1972 | DuRocher et al. | |
| 3,719,918 | A * | 3/1973 | Kerr | 439/319 |
| 4,737,119 | A | 4/1988 | Stieler | |
| 4,895,530 | A | 1/1990 | Gugelmeyer et al. | |
| 4,902,238 | A | 2/1990 | Iacobucci | |
| 5,474,466 | A * | 12/1995 | Sakuraoka et al. | 439/319 |
| 5,713,765 | A * | 2/1998 | Nugent | 439/319 |
| 6,226,068 | B1 | 5/2001 | Arcykiewicz et al. | |
| 6,290,525 | B1 | 9/2001 | Jacobi | |
| 6,364,681 | B1 * | 4/2002 | Watanabe | 439/335 |
| 6,402,533 | B1 | 6/2002 | Fan Wong | |
| 6,561,841 | B1 | 5/2003 | Norwood et al. | |
| 6,568,949 | B1 * | 5/2003 | Walters | 439/319 |
| 6,634,897 | B1 | 10/2003 | Cykon et al. | |

* cited by examiner

*Primary Examiner*—Tho D. Ta
(74) *Attorney, Agent, or Firm*—Notaro & Michalos PC

(57) ABSTRACT

An electrical connector assembly is provided for a light fixture. The assembly includes a base assembly which includes a female pin contact holder, a base housing adjacent the female pin contact holder, and having at least one guide post, and a stem. The assembly also includes a male pin contact holder having at least one tab, a hole at one end, a flange surrounding the hole, and an electrical male pin connector inside the male pin contact holder for connection with the female pin contact holder through the hole. A latch assembly includes a spring, a washer, and a latch housing. The latch housing has at least one bayonet slot at an open end for mating connection with the at least one guide post, at least one set of installation slots and resting seats on the inside surface of the housing, and a wall between the installation slots and resting seats having a peak and a ramp.

21 Claims, 6 Drawing Sheets

PUSH AND TWIST ELECTRICAL CONNECTOR ASSEMBLY

FIELD AND BACKGROUND OF THE INVENTION

The present invention relates generally to the field of electrical connectors and in particular to a new and useful electrical connector assembly for light fixtures.

There are many different types of light fixtures which have different types of sockets and different types of bulbs, such as incandescent lamp bulbs, fluorescent lamp bulbs, halogen lamp bulbs, and high intensity discharge (HID) lamp bulbs. As a result, when it is desired to change the type of lamp bulb used, it is necessary to change the entire light fixture because the socket of one type of lamp bulb will typically not accommodate other lamp bulb types.

Although the above-mentioned problem exists in environmental lighting in general, one example of the problem can also be illustrated in photography and imaging. U.S. Pat. No. 6,176,598 discloses a reflector of the umbrella type with a light fixture. The light fixture comprises a housing such as a metal cylindrical enclosure containing a socket for receiving and electric lamp. A cylindrical stem is connected to and extends rearwardly of the housing. A power cord is plugged into the rear of the stem and is electrically connected to the socket so that when a plug of the cord is plugged into an electrical outlet, the lamp can be lit. However, the light fixture is limited to only a certain type of bulb or bulbs that will be accommodated by the specific type of socket that is contained within the housing. In the fields of photography and imaging, it is often necessary to use different types of lighting, requiring a different lighting fixture type for each different lighting use or purpose. For using different types of lights with the reflector described above, the entire light fixture, including the housing and stem, has to be replaced which is cumbersome and inefficient.

There is a need in the field of lighting in general as well as in other fields which use lighting (e.g., imaging and photography) for an apparatus which can be used to easily and conveniently replace only the socket and bulb portions of the light fixture without having to replace the entire light fixture. Such a device is not known in the art.

Prior art which is relevant to the present invention, but does not solve the above-identified problem, can be found in U.S. patent classes and subclasses: 362/226 and 439/284, 286, 311, 318, 319, 332, 336. A list of the most relevant prior art references is provided below:

| U.S. Pat. No. | Inventor(s) |
|---|---|
| 1,304,075 | Lofgren |
| 2,005,475 | Schmidt |
| 2,093,037 | Douglas |
| 3,701,965 | DuRocher et al. |
| 4,737,119 | Stieler |
| 4,895,530 | Gugelmeyer et al. |
| 4,902,238 | Iacobucci |
| 6,226,068 | Arcykiewicz et al. |
| 6,290,525 | Jacobi |
| 6,402,533 | Fan Wong |
| 6,561,841 | Norwood et al. |
| 6,634,897 | Cykon et al. |

Some of these patents are described in more detail below. Although a variety of electrical connectors are known in the art as described below, none of these electrical connectors are designed for lighting fixtures or satisfy the problem identified above.

U.S. Pat. No. 3,701,965 to DuRocher et al. discloses a connector assembly comprising first and second electrical terminal carriers, a spring, and a housing.

The spring is introduced into the housing first. Then, the second terminal carrier is rotated with respect to the housing so that a flange of the second terminal carrier may enter a slot of the housing via gaps between flanges of the housing. Thus the second carrier is pushed axially into the body of the housing. The second terminal carrier is then further rotated so that respective flanges of the second terminal carrier and housing cooperate with one another to prevent axial movement. The spring is trapped between the housing and second terminal carrier, constantly biasing the second terminal carrier axially of the housing, while axial movement of the second terminal carrier is disabled by the cooperation between the flanges of the housing and second terminal carrier.

The first terminal carrier is then aligned such that it may move axially of the second terminal carrier. The first terminal carrier is rotated clockwise to move the flanges of the first terminal carrier into underlying relation with respect to the flanges of the housing. Simultaneously, the flanges of the second terminal carrier move into the gaps between the flanges of the housing such that the spring can expand and move the second terminal carrier axially with respect to the first terminal carrier. Because the first terminal carrier flanges are locked with the housing flanges, the first terminal carrier cannot be disassembled from the housing, thereby keeping the assembly connected.

Several patents also disclose bayonet connections involving a pin on one connector and a helical or J-shaped groove or cam slot on a mating connector. For example, U.S. Pat. No. 1,304,075 to Lofgren discloses a two-part separable connector comprising a socket shell and a second shell which is telescopingly fitted in the socket shell. The second shell carries radially projecting pins for engagement with slots in the socket shell.

U.S. Pat. No. 2,005,475 to Schmidt discloses an electrical connector assembly comprising a screw plug, a connector plug and a cylindrical sleeve mounted on the connector plug. A free edge of the sleeve is provided with a pair of diametrically arranged bayonet slots that are adapted to co-act with pins of the screw plug for locking the sleeve and connector plug to the screw plug. A spring is coiled about the exterior of the connector within the sleeve and between the shoulder of the connector and the end of the sleeve. The tendency of the spring is to push the sleeve away from the front face of the connector, or away from the screw plug when the connector is attached to the screw plug. The slots can be slipped over the pins, and then by a twist or turn of the sleeve, the bayonet slots are engaged with the pins to lock the sleeve and the connector to the screw plug.

U.S. Pat. No. 2,093,037 to Douglas discloses an electrical connector assembly in which bayonet pins are provided upon a first shell coacting with bayonet slots upon a complimentary second shell having the usual bayonet seat within which the pins are held seated by a spring exerting pressure on the first shell.

U.S. Pat. No. 4,895,530 to Gugelmeyer et al. discloses an electrical connector assembly comprising a plug connector having a housing and a pair of cam followers extending in diametrically opposed directions outwardly from the housing of the plug connector. The cam followers are cylindrical in configuration. The cam followers are spaced slightly rearwardly from the extreme front mating end of the housing. The electrical connector assembly further comprises a socket connector with a housing to be mated with the plug connector of the assembly. The socket connector has a housing with a forward mating end which contains a pair of generally helical cam slots on diametrically opposite sides of the housing. Each cam slot is dimensioned to slidably receive a cam follower from the housing of the plug connector.

U.S. Pat. No. 6,402,533 to Fan Wong discloses a decorative light plug having a female connector and a cover for the connector. The female connector has a flange formed on an outer periphery and a pair of keys formed on opposite sides of the female connector. The cover has a pair of L-shaped keyways formed on an inner face defining a blind hole and corresponding to the pair of opposed keys of the female connector. When the decorative light is not in use, the user may use the cover to engage with the decorative light by inserting the keys into the corresponding L-shaped keyways. After the keys are completely inserted into the keyways, the user may rotate the cover to hold the keys inside the L-shaped keyways and therefore secure the engagement between the cover and the decorative light.

Accordingly, a need remains for a solution to the problem described above.

SUMMARY OF THE INVENTION

It is an object of the present invention to provide a apparatus which can be used to easily and conveniently replace only the socket and bulb portions of the light fixture without having to replace the entire light fixture.

It is further object of the present invention to provide an easily connectable assembly for electrically mounting a latch assembly with a socket and light bulb.

Accordingly, a push and twist electrical connector assembly is provided for a light fixture. The assembly includes a base assembly having a female pin contact holder at a first end, a base housing adjacent the female pin contact holder and having at least one guide post, and a stem extending from the female pin contact holder to a second end which is opposite the first end.

The assembly further includes a latch assembly comprising a male pin contact holder as a body with at least one tab at a first end, a hole at a second end opposite the first end, a flange surrounding the hole, and an electrical male connector inside for connection with the electrical female connector through the hole. The latch assembly also includes a latch housing that has at least one open end, at least one bayonet slot at the open end for mating connection with the at least one guide post of the base housing, at least one set of an installation slot and resting seat on the inside surface of the latch housing, and a wall between the installation slot and resting seat having a peak and ramp. The latch assembly also includes a spring and a washer.

The base housing may have a plurality of guide posts and the male pin contact holder may have a plurality of tabs. In both cases, the guide posts or tabs may be diametrically opposed as well. Accordingly, the latch housing may have a plurality of bayonet slots, or diametrically opposed bayonet slots for receiving corresponding guide posts of the bayonet housing. Likewise, the latch housing may have a plurality of installation slots and resting seats for receiving corresponding tabs of the male pin contact holder.

The latch assembly is assembled by first inserting the spring and washer into the latch housing in front of the male pin contact holder. Then, by pushing the male pin contact holder against the latch housing, the tab is guided along the installation slot to the wall. After the tab crests the wall, the male pin contact holder is slightly rotated or twisted such that the tab moves past the peak, and the spring biases the male pin contact holder so that the tab moves down the ramp, and into the resting seat. The male pin contact holder is placed in the resting seat for the purpose of aligning the mating connection between the male pin contacts and the female pin contacts.

The base assembly is engaged with the latch assembly by pushing the base assembly against the latch assembly so that the male pin contacts and female pin contacts are engaged and so that the guide post is inserted into the bayonet slot of the latch housing, and the tab is pushed out of the resting seat, and rotating or twisting the base assembly with respect to the latch assembly so that the guide post is locked in the bayonet slot and the tab is elevated and rotated toward the peak, but the peak is not overcome. Thus, the male pin contact holder remains connected to the latch housing while the base assembly has been successfully connected to the latch assembly.

The latch assembly may receive a plurality of different types of platform assemblies, each for a different light source. The different types of platform assemblies for mounting different types of light sources (e.g., incandescent, fluorescent, halogen, and high intensity discharge, etc.) include a platform connected to the latch housing, and a socket unique for each different light source.

From the base, the stem carries electricity to the female pin contacts which carry electricity to the male pin contacts which carry electricity to the socket for supplying electricity to the particular light source engaged to the socket.

As a result, one type of socket and light bulb of a light fixture can easily be replaced with another type of socket and light bulb. However, a safety system is implemented so that a light source which is incompatible with the light fixture due to such factors as high heat or explosion potential cannot be added to the light fixture. Different numbers of protruding security screws, or no protruding security screws, in the base housing dictate whether the light fixture is compatible with all light sources, including most high temperature light sources, or only limited light sources that pose no danger (i.e., low temperature light sources). No security screws dictate that all light sources, including high temperature light sources, are compatible with the light fixture. If there is at least one protruding screw, then light fixture compatibility is restrictive to light sources having a particular temperature. An increasing number of protruding screws indicates that the compatibility of the light fixture to light sources is increasingly restrictive.

Latch housings are provided in different varieties having a different number of cutouts, including no cutouts. The number of cutouts dictates whether a particular latch housing will be compatible with a particular base assembly, if the protruding screw security level is restrictive (i.e., there is at least one protruding screw). The type of latch housing is chosen based on the light source to be used. A light source is attached to a latch housing via the platform assembly. A light source that is incompatible with the light fixture will only be attached to a latch housing having a security cutout that does not mechanically fit with the protruding security screw arrangement of the base assembly.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
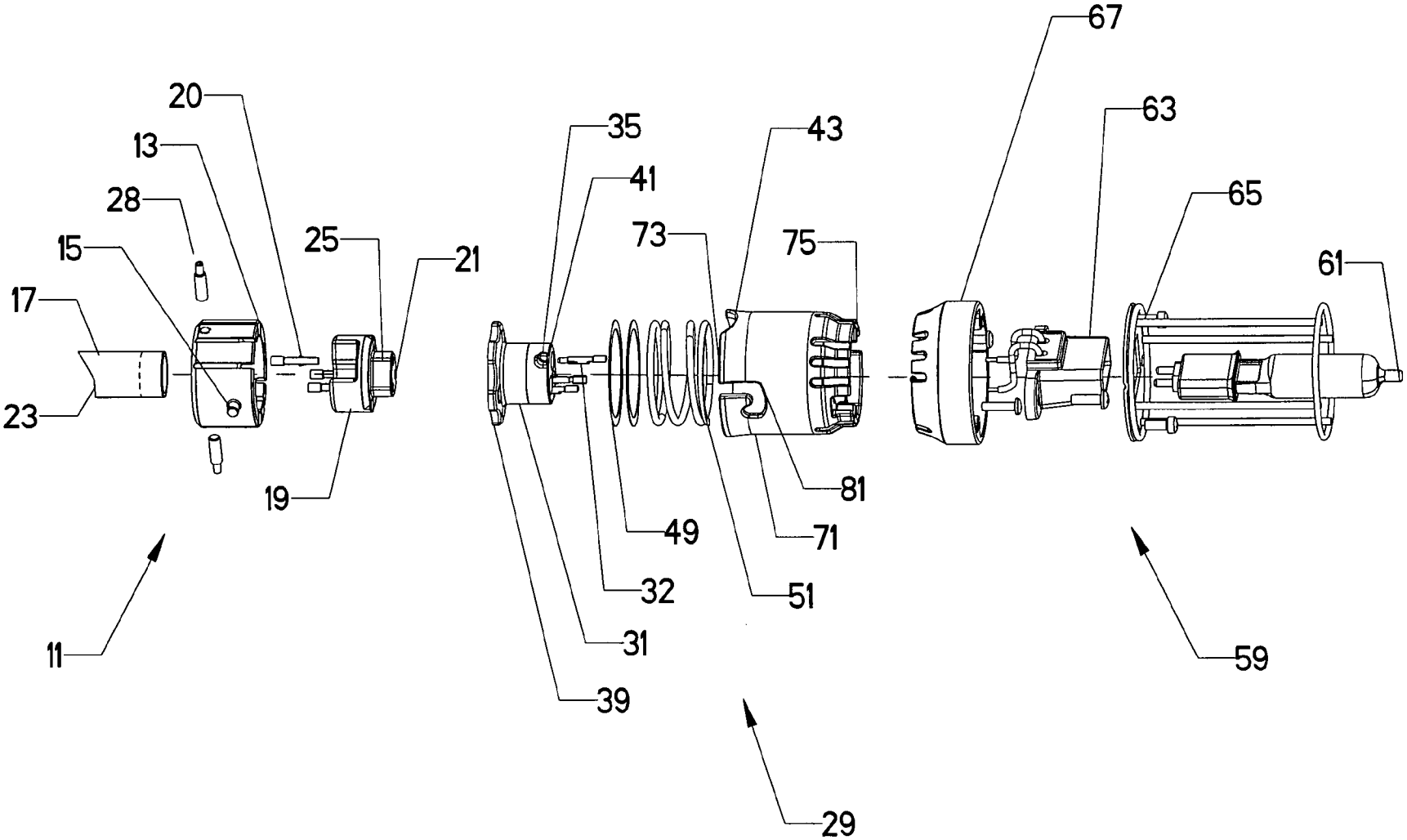
FIG. 1 is a side exploded view of the components of the base assembly, latch assembly, and an example of a platform assembly of the present invention, as there are many different platform assemblies that can be manufactured for use with the present invention.

Referring now to the drawings, in which like reference numerals are used to refer to the same or similar elements, FIG. 1 shows the components of a base assembly 11, a latch assembly 29, and an example of a platform assembly 59 for a light fixture or electrical device of the present invention.

The base assembly 11 includes a female pin contact holder 19 containing female pin contacts 20 and a male protrusion 25 at a first end 21 of the base assembly 11, a base housing 13 adjacent the female pin contact holder 19 and having diametrically opposed guide posts 15 which are cylindrical, and a stem 17 extending from the base housing to a second end 23 which is opposite the first end 21. The female pin contact holder has a male protrusion 25 for mating the female pin contact holder 19 to a male pin contact holder 31. The female contacts are examples of first contacts of the invention that are part of the base assembly.

Although the guide posts 15 are preferably cylindrical, they may be any other shape suitable for guiding the base assembly 11 as will be described in more detail below. The guide posts 15 are aluminum, but may be made of other solid or rigid materials such as stainless steel.

The base housing 13 also includes two holes in its walls which are perpendicular to the stem 17, and which receive security screws 28, that either completely fit in the holes or protrude from the holes. This arrangement of security screw fits is a safety system implemented so that a light source which is incompatible with the light fixture due to such factors as high heat or explosion potential cannot be added to the light fixture. Different numbers of protruding security screws, or no protruding security screws, in the base housing dictate whether the light fixture is compatible with all light sources, including most high temperature light sources, or only limited light sources that pose no danger (i.e., low temperature light sources). Specifically, 0, 1, and 2 security screws are used to define different security levels. No security screws dictate that all light sources, including high temperature light sources, are compatible with the light fixture. If there is at least one protruding screw, then compatibility is restrictive. An increasing number of protruding screws indicates that the compatibility of the light fixture with light sources is increasingly restrictive. Two security screws 28 requires light sources that pose the least danger (i.e., light source with the lowest temperature). The safety system also includes other features which operate together with the security screws 28, which will be described in more detail below.

The base assembly 11 is mechanically assembled as follows. The base housing 13 includes a hole in the center which receives the stem 17. The female pin contact holder 19 is attached to the base housing 13 using two #4 screws that pass through the female pin contact holder 19 and into holes in the base housing 13.

The base assembly 11 also contains the following electrical components. There are three conductors inside the base assembly 11; hot, neutral, and ground. The ground conductor is spliced with a short jumper of the same gauge into a ring terminal. The ring terminal is attached to the inside of the base assembly with a #6-32 screw to ground the die-cast housing. The hot, neutral, and ground jumper have a pin contact terminal crimped on to them. These three pin contacts 20 are then fed into the receptacle holes 27 of the female pin contact holder 19 where they are pushed and locked into place. Two spring back tines on the pin contacts 20 prevent the contacts from being pushed back out from the female pin contact holder 19 during electrical connection.

The latch assembly 29 includes male pin contact holder 31 which includes diametrically opposed rectangular tabs 35 at a first end 41, a hole 37 (see FIG. 3) at a second end opposite the first end 41, a flange 39 surrounding the hole 37, and male pin contacts 32 inside the male pin contact holder 31 for connection with the female pin contacts 20 in female pin contact holder 19 when male protrusion 25 is inserted into hole 37. Although the tabs 35 are preferably rectangular, they may be cylindrical or any other suitable shape for guiding the male pin contact holder 31 as described below. The male protrusion 25 and the hole 37 are complementary and D-shaped. However, they may be any other shape which prevents them from rotating with respect to each other.

The male pin contact holder 31 is made of teflon, ceramic, porcelain, steatite, or other technical ceramic compound, or of an assembly of different materials, e.g. a steel collar with tabs 35 attached to a ceramic body. It may also be made of a polymeric compound. There may be temperature requirements depending on the conditions of use.

Figure 6:
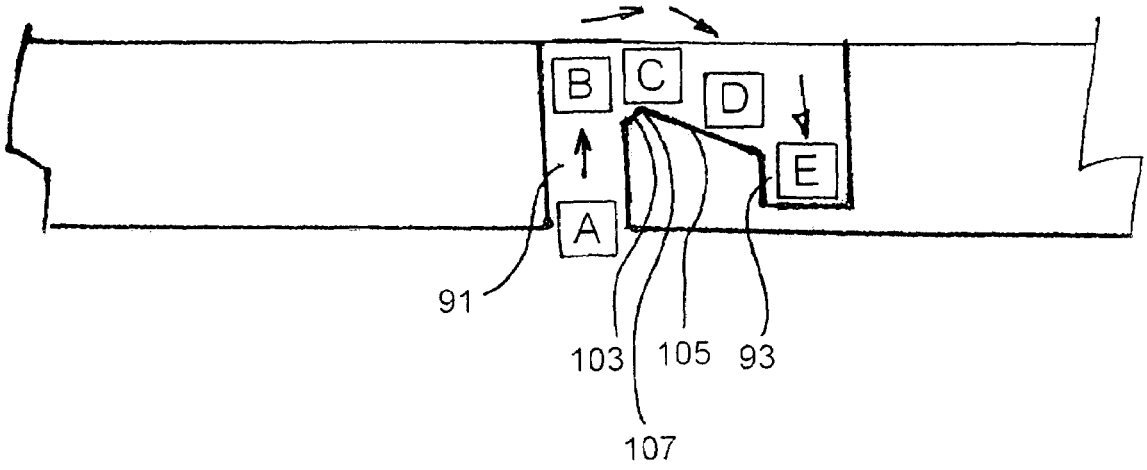
FIG. 6 is a schematic representation of the inner cam surfaces (the installation slot and the resting seat) of the latch housing and blocks illustrating the steps for assembling the latch assembly.
Figure 7:
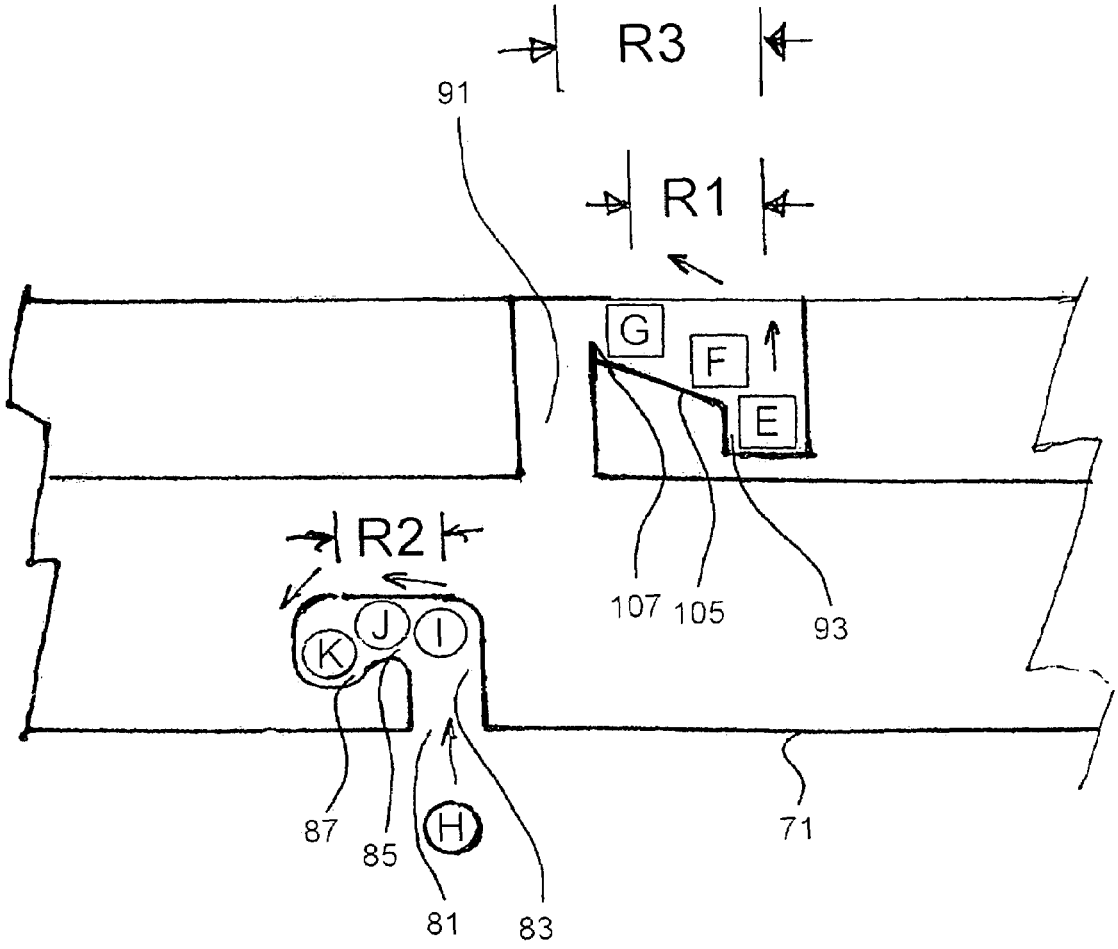
FIG. 7 is a schematic representation of the inner cam surfaces (the installation slot and the resting seat) of the latch housing and blocks illustrating the steps for connecting the base assembly to the latch assembly.

The latch assembly 29 further includes a latch housing 71 which includes an open end 73, an opposite end 75, and a pair of diametrically opposed bayonet slots 81 at the open end 73 for mating connection with the diametrically opposed guide posts of the base assembly 11. Although the bayonet slots are J-shaped in FIG. 1, they may also be L-shaped as shown in FIGS. 6–7 for example, or any other suitable hook shape which consists of a path that similarly changes direction.

The top of the latch housing, opposite the electrical connection, has four #6 screw holes. Two of these holes are level with the top of the latch housing. These holes are used for mounting the platform as will be described in more detail below. The other two holes are recessed below the top of the latch housing and are occasionally used for mounting and usually used for connecting a grounding wire. There is also a multitude of venting holes located at the top of the latch housing to vent hot air.

At the bottom of the latch housing, there are a varying number of semicircular cutouts, or no cutouts, that are part of the safety system, which works with the security screws 28 in the two holes in the base housing 13 perpendicular to the stem 17. The number of cutouts dictates whether a particular latch housing will be compatible with a particular base housing, if the protruding screw 28 security level is restrictive (i.e., there is at least one protruding screw 28). The type of latch housing is chosen based on the light source to be used. A light source is attached to a latch housing via the platform assembly as will be explained in more detail below. A light source that is incompatible with the light fixture will only be attached to a latch housing having a security cutout that does not mechanically fit with the protruding security screw arrangement of the base housing.

The security level of the latch housing 71 is defined by 0, 1, or 2 cutouts. No cutouts represents the most interference with the security screws 28 in the base housing 13 and thus would be paired with highest temperature light source that requires the most protective housing to limit the user's ability to install that particular light source into an incompatible light fixture. Two cutouts represent the least interference and thus would be paired with the lowest temperature light source. If the light fixture compatibility is restrictive and requiring lower temperature light sources, there is no compatibility problem with using the lowest temperature light source.

If the light source compatibility is not restrictive (light sources at any temperature are allowed), then no security screws 28 protrude, and a latch housing 71 having any number of cutouts (for light sources with lower temperatures), or no cutouts (for light sources with higher temperatures), can be used.

Figure 2:
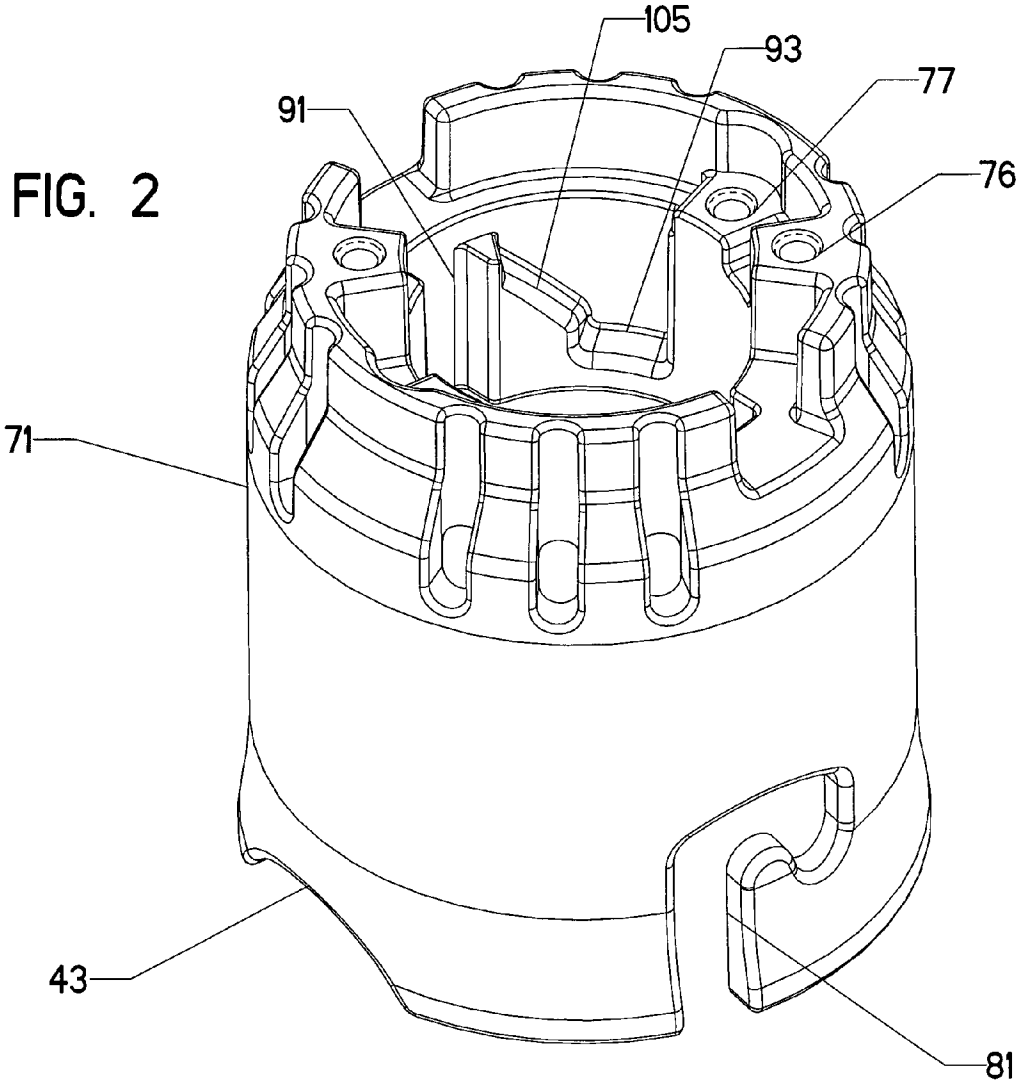
FIG. 2 is a perspective view of the latch housing of the latch assembly.

FIG. 2 shows the inside of the latch housing 71, which includes a first installation slot 91 and a resting seat 93 on the inside surface of the housing, and a wall between the installation slot 91 and the resting seat 93 having a ramp 105 leading up to a peak 107 (see FIGS. 6 and 7). The top of the latch housing, opposite the electrical connection, has four #6 screw holes 76, 77. Two of these holes 76 are level with the top of the latch housing. These holes 76 are used for mounting the platform. The other two holes 77 are recessed below the top of the latch housing and are occasionally used for mounting and usually used for connecting a grounding wire.

FIG. 6 shows the steps for assembling the latch assembly 29. The spring 51, the male pin contact holder 31, and the washer 49 are connected to the housing 71. The spring 51 and thrust washer 49 are inserted into the housing 71 first. Then, the male pin contact holder 31 is inserted into the latch housing 71 and pressed against the washer 49 and spring 51. The male pin contact holder 31 is connected to the latch housing 71 by properly aligning and guiding the diametrically opposed tabs 35 of the male pin contact holder 31 along the respective first installation slots 91 (Steps A–B) until the end of the slots 91 are reached, slightly rotating the male pin contact holder 31 a few degrees clockwise such that its respective tabs 35 move past the peak 107 (Step C), and the spring 51 then biases against the flange 39 so that the tabs 35 move down the ramp 105 (Step D), and into the respective resting seat 93 (Step E). That is, pressure is required to push the male pin contact holder until the tabs crest the installation slot, and after the male pin contact holder is slightly rotated, pressure from the biasing of the spring against the flange 39 is transferred to the tabs 35 which follow ramps 105 into respective resting seats 93. The washers 49 provide a lubricated surface allowing the male pin contact holder 31 to rotate smoothly, but are not required for operation. The male pin contact holder 31 can be thought of as a body that is at least partly in the latch housing 71 of the latch assembly, and which supports the male pin contacts that are examples of second contacts of the invention.

The example platform assembly 59 includes a platform 67 containing a socket 63, a protector 65 and at least one light source 61, which is an example of an additional electrical device of the present invention. The platform 67 provides mounting screw holes for mounting the socket 63 to the platform 67, channels for the electrical leads of the socket to pass through, mounting holes for the platform 67 to attach to the latch housing 71, and finally mounting means such as screw holes, for a protector 65 to be mounted on top. Upon assembly, the light source 61 is electrically connected to the socket 63 via electrical contacts. The socket 63 in turn is electrically connected to the male pin contacts 32 via electrical leads when the latch assembly and platform assembly are connected.

It is noted that a lamphead is a manufactured assembly comprising a latch assembly and platform assembly. In order to change a light source the user disengages the lamphead from the base assembly and replaces it with a different lamphead. The user never disassembles the platform assembly from the latch assembly.

Figure 3:
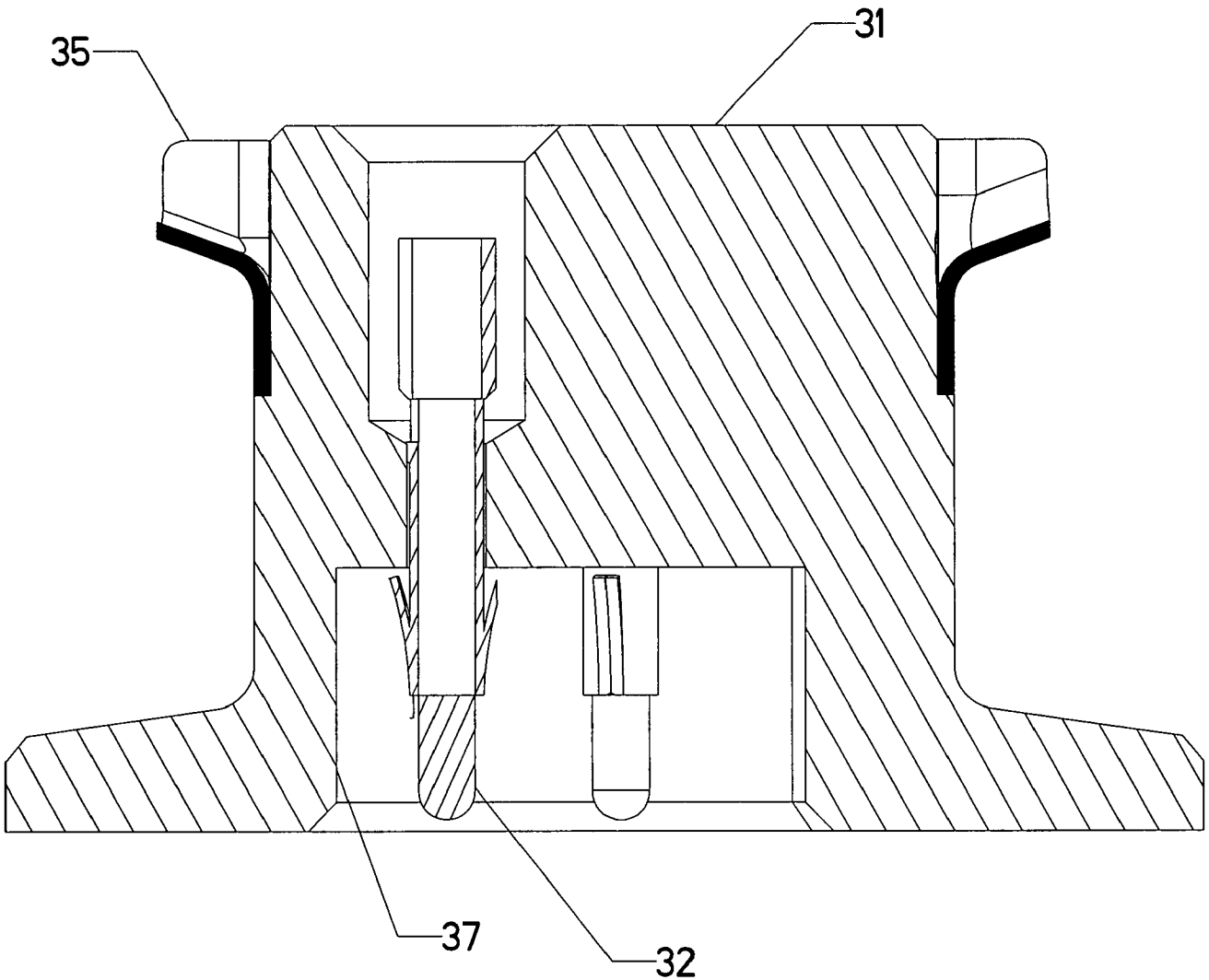
FIG. 3 is a side sectional view of the male pin contact holder.
Figure 4:
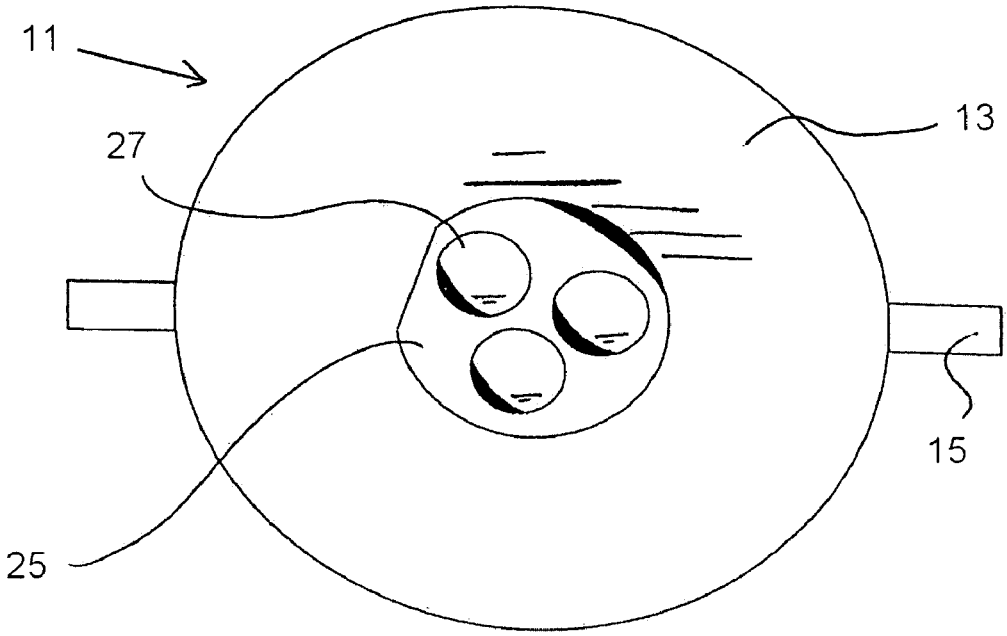
FIG. 4 is a top plan view of the base assembly.
Figure 5:
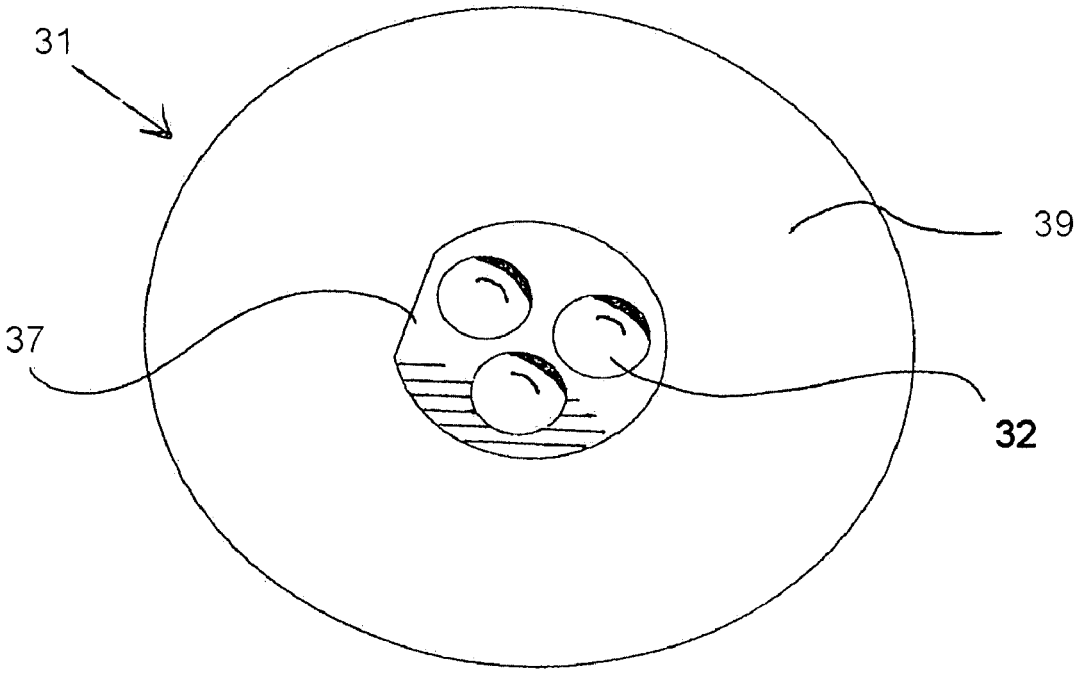
FIG. 5 is a bottom plan view of the latch assembly.

Thus, once the base assembly 11, latch assembly 29, and platform assembly 59 are properly connected, the light source receives electricity as follows. The stem 17 is a conduit for carrying an electrical cable from an outside power source such as an outlet to the female pin contact holder 19. The electrical cable carries electricity to the female pin contacts 20. As shown in FIGS. 3–5, the female pin contact holder comprises three holes 27 at end 23 and the male pin contact holder 31 comprises three male pin contacts 32 at end 43, which are inserted into the three holes 27 of the female pin contact holder 19 for contacting the female pin contacts 20 therein. Electricity is thereby carried from the female pin contacts 20 to the male pin contacts 32. The electricity then travels from the male pin contacts 32 of the male pin contact holder 31 to the socket 63 via electrical leads, and then to the electrical pins of the light source connected to the socket 63.

The base assembly 11 is connected to the latch assembly 29 as shown in FIG. 7. The guide posts 15 of the base assembly 11 are aligned with the bayonet slots 81. The protrusion 25 of the female pinholder 19 is inserted into the hole 37 of the male pinholder 31 and simultaneously the guide posts 15 of the base assembly 11 are inserted into the entry channel 83 of the bayonet slots 81 of the housing 71 (Steps H–I). Preferably, the guide posts 15 are different sizes, and the bayonet slots 81 have a corresponding difference in size, so that the latch assembly 29 and base assembly 11 can only be aligned in a way that ensures that mating ends protrusion 25 and hole 37 are properly aligned for mating. Then, the base assembly 11 is pushed against and moves the male pin contact holder 31 forward, and the tabs 35 of the male pin contact holder 31 escape the respective resting seats 93 (Steps E–F). The base assembly 11 is rotated so that the guide posts 15 are moved along the locking channel 85 to the end position 87 to lock the guide posts 15 of the base assembly 11 in the bayonet slots 81 of the housing 71 (Steps J–K). During rotation, the tabs 35 of the male pin contact holder 31 are elevated and rotated toward the peak 107 (Step G). However, the tabs 35 do not overcome the peak 107, and therefore, the male pin contact holder 31 remains connected to the latch housing 71, while the base assembly 11 has been successfully connected to the latch assembly 29.

The distance R1 is the rotational distance from the resting seat 93 to the peak 107. The distance R2 is the rotational distance from the length of the locking channel 85. The distance R3 is the distance from the resting seat 93 to the installation slot 91, or the length of the wall. As shown in FIG. 7, R3 is greater than R1 and R2, which prevents the male pin contact holder 31 from escaping when the base assembly 11 is connected to the latch housing. Also, R1 is equal to R2, wherein R1 defines a limited amount of rotation of the male pin contact holder 31 that permits the base assembly 11 to lock its guide posts 15 in the bayonet slots 81, without the tabs 35 of the male pin contact holder 31 escaping into the installation slot 91 and releasing the male pin contact holder 31.

The base assembly 11 is disconnected from the latch assembly 29 by slightly pushing forward and rotating the base assembly 11 with respect to the latch assembly 29 to release the guide posts 15 from the end position 87 to the entry channel 83 of the bayonet slot 81, and then pulling the base assembly 11 to pull the guide posts 15 out of the entry channel 83 and the protrusion 25 out of the hole 37. When the base assembly 11 is slightly rotated to release the guide posts 15 from the end position 87, the connection between the protrusion 25 and the hole 37 forces the male pin contact holder 31 to be simultaneously rotated in the same direction to bring the tabs 35 back into the resting seat 93. Any misalingment of the male pinholder within the latch housing will be corrected by the expansion of the spring 51 against the flange 39 forcing the tabs 35 to follow the ramp 105 into the resting seat 93.

The latch assembly 29 is disassembled by pushing the male pin contact holder 31 against the housing 71 to move the tabs 35 out of the resting seats 93 of the housing 71, rotating the pin holder 31 until the tabs 35 reach the installation slots 91 at which point, the pushing is stopped and the spring 51 biases the tabs 35 to be guided out of the housing 71 along the installation slot 91 so that the male pin contact holder 31, washer 49, and spring 51 can be removed.

The bayonet slots with guide posts as shown, for example, in FIG. 1, are a non-limiting example of the opposite and complimentary mechanical features on the base assembly and latch assembly that allow electrical and mechanical connection of the base assembly and the latch assembly. The tabs 35 and the parts that interact therewith, are a non-limiting example of further opposite and complimentary mechanical features for repeatedly connecting and allowing axial and rotational movement of the latch housing with respect to the body and allowing the body to remain stationary with respect to the first contacts, the further opposite and complimentary features also allowing automatic realignment of the body in the latch housing for repeated connection of the first and second contacts.

By virtue of the modular nature of the light fixture assemblies described above, one type of socket and light bulb of a light fixture can easily be replaced with another type of socket and light bulb. However, a safety system is implemented so that a light source which is incompatible with the light fixture due to such factors as high heat or explosion potential cannot be added.

While a specific embodiment of the invention has been shown and described in detail to illustrate the application of the principles of the invention, it will be understood that the invention may be embodied otherwise without departing from such principles.

What is claimed is:

1. A push and twist electrical connector assembly for a light fixture that passes electricity from a power source to a light source mounted to the connector assembly to allow different light sources to be engaged to the same light fixture comprising:

a base assembly having an electrical female connector at a first end, a base housing adjacent the electrical female connector and having at least one guide post, and a stem extending from the base housing to a second end which is opposite the first end;

a latch assembly comprising:

a latch housing having at least one open end, at least one bayonet slot at the open end for mating connection with at least one guide post of the base housing, at least one set of an installation slot and a resting seat on the inside surface of the latch housing, and a wall between the installation slot and resting seat having a peak portion and a ramp;

a spring; and a body with at least one tab at a first end sitting in the resting seat of the latch housing, a hole at a second end opposite the first end, a flange surrounding the hole, and an electrical male connector inside the body for connection with the electrical female connector through the hole;

wherein the latch assembly is connectable to and detachable from the base assembly.

2. A push and twist electrical connector assembly for a light fixture according to claim 1, wherein the at least one bayonet slot is J-shaped or L-shaped.

3. A push and twist electrical connector assembly for a light fixture according to claim 1, wherein said base housing has more than one guide post and said latch housing has more than one corresponding bayonet slot, said guide posts are different sizes, and said bayonet slots are different sizes corresponding to said guide posts, so that alignment of mating ends of the latch assembly and base assembly is ensured.

4. A push and twist electrical connector assembly for a light fixture according to claim 1, wherein the electrical male connector is three contact pins and the electrical female connector has three holes with three contact pins arranged tor receiving and connecting to the three contact pins of the male connector.

5. A push and twist electrical connector assembly for a light fixture according to claim 1, wherein the base assembly is connectable to the latch assembly by connecting the electrical male connector to the electrical female connector while inserting the at least one guide post of the base housing into the bayonet slot of the latch housing, pushing the base assembly against the latch housing until the tab of the body escapes the resting seat, and rotating the base housing wherein a biasing force of said spring seats said guide posts in the bayonet slots of the latch housing.

6. A push and twist electrical connector assembly for a light fixture according to claim 1, wherein the base housing has diametrically opposed guide posts and the latch housing has diametrically opposed bayonet slots.

7. A push and twist electrical connector assembly for a light fixture according to claim 1, wherein the body has plural tabs and the latch housing has plural installation slots and resting seats on the inside surface of the housing for the tabs.

8. A push and twist electrical connector assembly for a light fixture according to claim 1, including a platform assembly adapted to be fixed to the latch housing so that the latch housing with the fixed platform assembly is removable as a unit from the base assembly, the platform assembly including means for detachably receiving a light source and for passing electrical power from the base assembly to the light source.

9. A push and twist electrical connector assembly for a light fixture according to claim 8, including a plurality of platform assemblies each adapted to be fixed, one at a time, to the latch housing so that the latch housing with a fixed platform assembly is removable as a unit from the base assembly, the platform assemblies each including means for detachably receiving different light sources and for passing electrical power from the base assembly to each light source.

10. A push and twist electrical connector assembly for a light fixture according to claim 1, wherein the at least one bayonet, slot comprises an entry channel at said open end of the housing and a locking channel substantially perpendicular to the entry channel which terminates at an end position.

11. A push and twist electrical connector assembly for a light fixture according to claim 10, wherein the rotational distance from the resting seat to the peak is at least greater than to the rotational length of the locking channel.

12. A push and twist electrical connector assembly for a light fixture according to claim 10, wherein the rotational distance from the resting seat to the installation slot is greater than the rotational distance from the resting seat to the peak or the rotational length of the locking channel.

13. A push and twist electrical connector assembly for a light fixture comprising:

a base assembly having an electrical female connector at a first end, a base housing adjacent the electrical female connector and having plural guide posts, and a stem extending from the base housing to a second end which is opposite the first end;

a latch assembly comprising:

a latch housing having at least one open end, plural bayonet slots at the open end for mating connection with the guide posts of the base housing, at least one set of installation slots and resting seats on the inside surface of the housing, and a wall between the installation slot and resting seat having a peak portion and a ramp;

a spring; and a body having plural tabs at a first end sitting in the respective resting seats of the latch housing, a hole at a second end opposite the first end, a flange surrounding the hole, and an electrical male connector inside the body for connection with the electrical female connector through the hole;

wherein the body is not rotatable with respect to the base assembly, and the latch housing is rotatable with respect to the body and the base assembly, to mechanically engage the base assembly and latch assembly and to positively connect the electrical male and female connectors.

14. A push and twist electrical connector assembly for a light fixture according to claim 13, wherein the bayonet slots are J-shaped or L-shaped.

15. A push and twist electrical connector assembly for a light fixture according to claim 13, wherein the electrical male connector has three contact pins and the electrical female connector has three holes with three contact pins arranged tor receiving and connecting to the three contact pins of the male connector.

16. A push and twist electrical connector assembly for a light fixture according to claim 13, wherein the base assembly is connectable to the latch assembly by connecting the electrical male connector to the electrical female connector while inserting the guide posts of the base housing into the bayonet slots of the latch housing, pushing the base assembly against the latch housing until the diametrically opposed tabs of the body escape the respective resting seats, and rotating the base housing wherein a biasing force of said spring seats said guide posts in the bayonet slots of the latch housing.

17. A push and twist electrical connector assembly for a light fixture according to claim 13, including a platform assembly adapted to be fixed to the latch housing so that the latch housing with the fixed platform assembly is removable as a unit from the base assembly, the platform assembly including means for detachably receiving a light source and for passing electrical power from the base assembly to the light source.

18. A push and twist electrical connector assembly for a light fixture according to claim 17, including a plurality of platform assemblies each adapted to be fixed, one at a time, to the latch housing so that the latch housing with a fixed platform assembly is removable as a unit from the base assembly, the platform assemblies each including means for detachably receiving different light sources and for passing electrical power from the base assembly to each light source.

19. A push and twist electrical connector assembly for a light fixture according to claim 13, wherein the bayonet slots each comprise an entry channel at said open end of the housing and a locking channel substantially perpendicular to the entry channel which terminates at an end position.

20. A push and twist electrical connector assembly for a light fixture according to claim 19, wherein the rotational distance from the resting seat to the peak is equal to the length of the locking channel.

21. A push and twist electrical connector assembly for a light fixture according to claim 19, wherein the rotational distance from the resting seat to the installation slot is greater than the rotational distance from the resting seat to the peak or the length of the locking channel.

* * * * *